United States Patent [19]

Baker et al.

[11] Patent Number: 4,792,302

[45] Date of Patent: Dec. 20, 1988

[54] CONTINUOUS SOLDER REFLOW SYSTEM

[75] Inventors: Michael C. Baker, Wilmington; W. James Hall, Newton Corner, both of Mass.

[73] Assignee: Dynapert-HTC Corporation, Farmington, Conn.

[21] Appl. No.: 116,186

[22] Filed: Nov. 3, 1987

[51] Int. Cl.[4] ..... F27B 9/28

[52] U.S. Cl. ..... 432/59; 432/175; 432/202

[58] Field of Search ..... 432/8, 59, 175, 202

[56] References Cited

U.S. PATENT DOCUMENTS

| | | | |
|---|---|---|---|
| 3,744,963 | 7/1973 | Flynn | 432/59 |
| 4,116,620 | 9/1978 | Stibbe | 432/59 |
| 4,217,090 | 8/1980 | Whike et al. | 432/59 |
| 4,378,207 | 3/1983 | Smith | 432/59 |
| 4,474,552 | 10/1984 | Smith | 432/8 |
| 4,529,379 | 7/1985 | DiCastri | 432/59 |

*Primary Examiner*—Henry C. Yuen

*Attorney, Agent, or Firm*—Spencer T. Smith

[57] ABSTRACT

An oven includes a plurality of pairs of upper and lower spaced non-focused infrared heater panels. Product is conveyed between these panels to effect solder reflow. To increase heat transfer and to achieve temperature uniformity, air is forced through equally spaced holes drilled in the insulating block of one or more upper heating panels. To define an equal flow through these holes, a valve is placed below the air intake opening to define an annular opening between the panel casing and the valve. The valve has openings having an area which is matched to the annular area between the casing and the valve.

2 Claims, 2 Drawing Sheets

FIG. 2
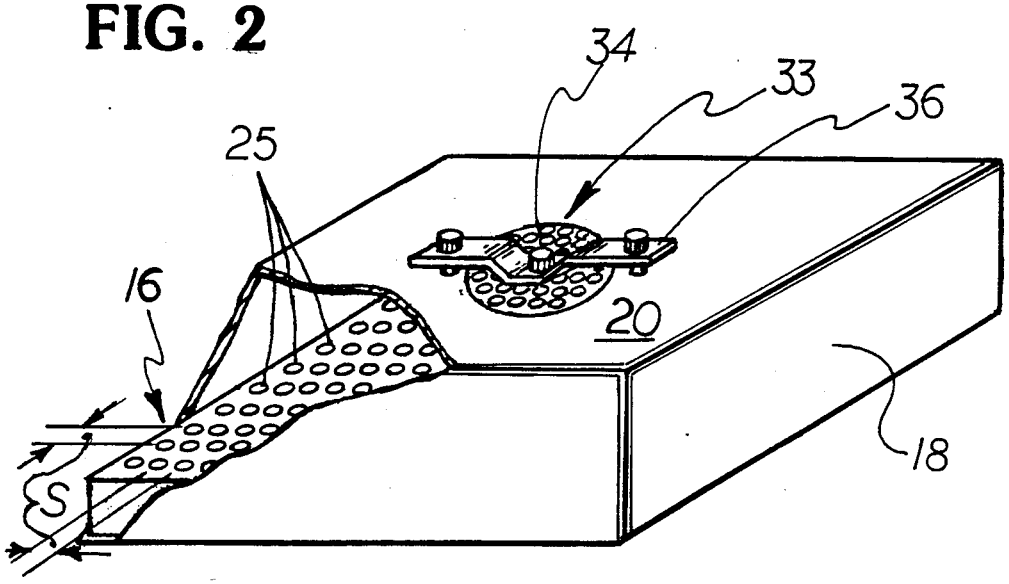
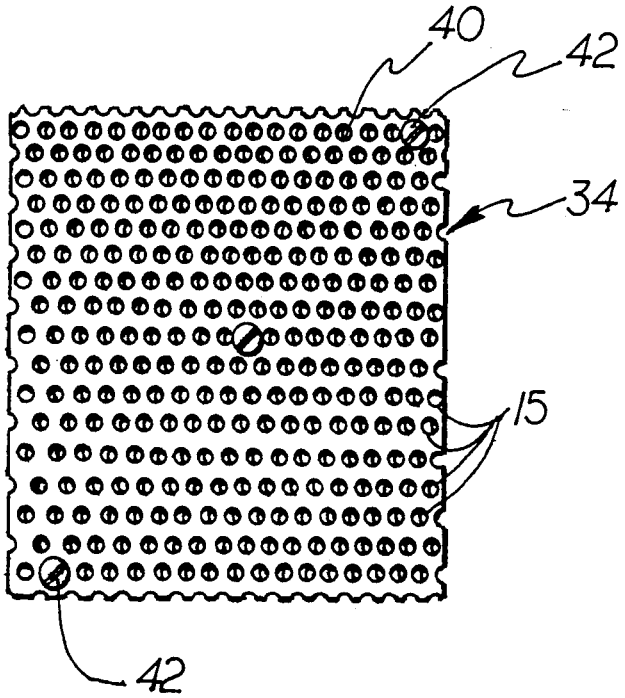
FIG. 3

CONTINUOUS SOLDER REFLOW SYSTEM

Reflow soldering of electronic components on printed circuit boards can be achieved by conveying the product through an oven which heats the solder to its liquidus temperature. The heating elements may be non-focused, infrared panels which are arranged in upper and lower rows spaced to permit passage of the product therebetween. Since infrared heating is line of sight heating, any shadowed surface or component will heat up at a different rate than the same surface or component which is directly exposed to the infrared source. To increase temperature uniformity and to increase the heat transfer rate, holes may be drilled through an upper panel so that air can be forced through the panel to impact against the product thereby causing substantial convective heat transfer. The air is then pulled through similar holes in the corresponding lower panel and exhausted from the system.

When such holes were located at equal spacings throughout the panel, uneven heating took place across the conveyor. To overcome this deficiency, more holes have been defined in the panel along the sides of the conveyor than along its center and great efforts are taken to define a hole pattern that will yield the desired uniformity.

It is an object of the present invention to utilize infrared panels having uniformly spaced holes and yet achieve uniform across the conveyor.

Other objects and advantages of the present invention will become apparent from the following portion of the specification and from the drawings which illustrate in accordance with the mandate of the patent statutes a presently preferred embodiment of the invention.

Referring to the drawings:

FIG. 2 is an oblique view of one of the center non-focused infrared heating panels of the system illustrated in FIG. 1 with a corner cut away to show the insulating block; and FIG. 3 is a top view of the valve element used in the heating panel illustrated in FIG. 2.

Figure 1:
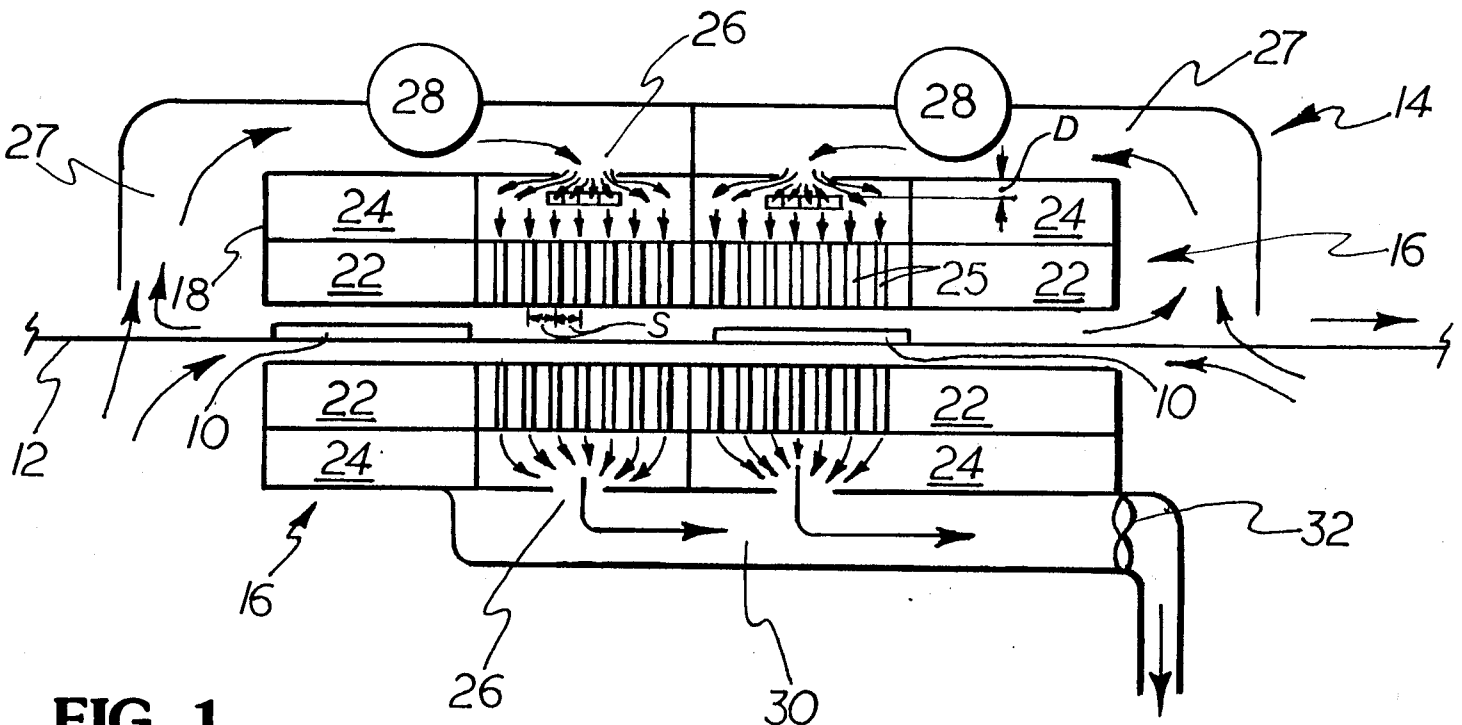
FIG. 1 is a schematic illustration of a continuous solder reflow system made in accordance with the teachings of the present invention.

Produce 10 (for example, a printed circuit board with surface mounted components placed on the board for reflow soldering) is conveyed by a conveyor 12 through an oven 14 having four adjacent upper and lower pairs of vertically spaced non-focused infrared heating panels 16. These panels all start out as standard panels having a metallic box-like casing 18 having a top surface 20 and an open bottom. An insulating block 22 is located within the bottom opening and defines a closed volume of air 24 with the top portion of the casing 18 (While the upper panel is placed with the insulating block at the bottom and the lower panel is placed vice versa, the top of the panel is intended to refer to the end opposite the insulating block.).

To increase heat transfer to the product as it passes between the second and third pairs of upper and lower panels 16, holes 25 are drilled through the insulating blocks from the top surface to the bottom surface of the block. The holes all are of the same size and are equally spaced S in an X-Y grid. A large opening 26 is centrally defined in the top casing surface 20 of the second and third upper and lower pairs of panels. Air can be drawn into an intake manifold 27 by a draft inducer 28, and forced into the casing 18 and through the insulating block holes 25 of the second and third (center) upper panels downwardly against the product to achieve convective heat transfer. This air is then pulled through the insulating block holes 25 and then through the large casing opening 26 of the lower panels and exhausted from an exhaust manifold 30 by a fan 32.

To establish substantially the same volume of air flow downwardly through each hole in an upper panel, a two passageway valve 33 is defined at the housing opening 25. A perforated valve body 34 which is a planar member at least as big as the opening and which is secured in parallel relation with the top surface by a mounting bracket 36 is located a selected vertical distance D below the top surface of the panel housing thereby defining an annular opening or passageway of selected area between the periphery of the valve body and the top surface 20 of the casing. A second passageway 15 is collectively defined by the holes or perforations in the valve body. The ratio of these passageway areas controls the pressure throughout the air volume and can be adjusted by varying the size of these two passageways to define a uniform pressure throughout the casing above the insulating block so that the volume of air flowing through each insulating block hole will be substantially the same thereby assuring uniform heating across the conveyor.

In the preferred embodiment, the valve is defined by upper and lower perforated sheets which are laterally shifted to define oblong openings. The laterally shifted sheets are secured to each other by suitable fasteners 42. A pressure change through the perforated valve body is controlled by the ratio of open to closed pathways within the boundary dimension of the valve.

What is claimed is:

1. A continuous solder reflow system comprising an oven including a plurality of pairs of upper and lower non-focused infrared heater panels spaced to define a heating zone, conveyor means for conveying product to be reflow soldered through said heating zone, each of said heater panels including a casing open at the bottom, and an insulating block supported within said bottom opening and spaced from the top surface thereof, at least one of the upper panels additionally including a plurality of equally spaced and sized holes extending from the top surface to the bottom surface of said insulating block, and an air intake opening in the top surface of said casing, means for forcing air through said air intake opening into said casing, valve means including a flat body portion at least as large as said air intake opening with a plurality of of holes extending therethrough, and means for mounting said body portion below said air intake to define an annular opening between said top surface and said valve body portion, the ratio of the area of said annular opening and the area of said valve body holes being adjusted to define a uniform pressure throughout said casing above said insulating block so that a uniform volume of air will flow through each of said holes in the insulating block.

2. A continuous solder reflow system according to claim 1, wherein said valve means comprises first and second sheets of identically perforated material and further comprising means for securing said sheets in offset relation.

* * * * *